United States Patent [19]

Sato et al.

[11] 4,105,199

[45] Aug. 8, 1978

[54] PAPER FEEDER COMPRISING A SELECTIVELY DRIVABLE RESILIENT BODY IN FRICTIONAL CONTACT WITH A FEED ROLLER

[75] Inventors: Kazukiyo Sato; Katuo Takahashi; Junjiro Kubota; Keiji Tsuchiya, all of Tokyo, Japan

[73] Assignee: Nippon Electric Co., Ltd., Tokyo, Japan

[21] Appl. No.: 752,952

[22] Filed: Dec. 20, 1976

[30] Foreign Application Priority Data

Dec. 22, 1975 [JP] Japan ..... 50-153016
Oct. 21, 1976 [JP] Japan ..... 51-141732[U]

[51] Int. Cl.[2] ..... B65H 3/52
[52] U.S. Cl. ..... 271/122; 271/272
[58] Field of Search ..... 271/122, 125, 172, 272, 271/34, 35; 192/51

[56] References Cited

U.S. PATENT DOCUMENTS

| | | | |
|---|---|---|---|
| 1,426,904 | 8/1922 | Olson | 271/125 |
| 2,494,156 | 1/1950 | Bechler | 192/51 |
| 2,974,537 | 3/1961 | Wheeler | 192/51 X |
| 3,044,770 | 7/1962 | Breuers | 271/122 |
| 3,684,278 | 8/1972 | Takahaski | 271/172 |
| 3,937,453 | 2/1976 | Hickey et al. | 271/122 X |
| 3,937,455 | 2/1976 | Hauser | 271/122 X |

*Primary Examiner*—Bruce H. Stoner, Jr.
*Attorney, Agent, or Firm*—Sughrue, Rothwell, Mion, Zinn and Macpeak

[57] ABSTRACT

A paper feeder comprises a controllably drivable resilient body in frictional contact with a feed roller. A preliminary feeder is provided for supplying a sheet of paper towards an area of the frictional contact from a stack of paper. The roller is driven in a first sense of rotation to feed the supplied paper away from the preliminary feeder. The resilient body is usually driven in a second sense towards the preliminary feeder at the frictional contact area and selectively set free on feeding a thin or flexible sheet. The resilient body may further be driven in the first sense on feeding either a thin or flexible sheet or a ground sheet on which another sheet of paper is attached.

3 Claims, 6 Drawing Figures

FIG. 1
PRIOR ART
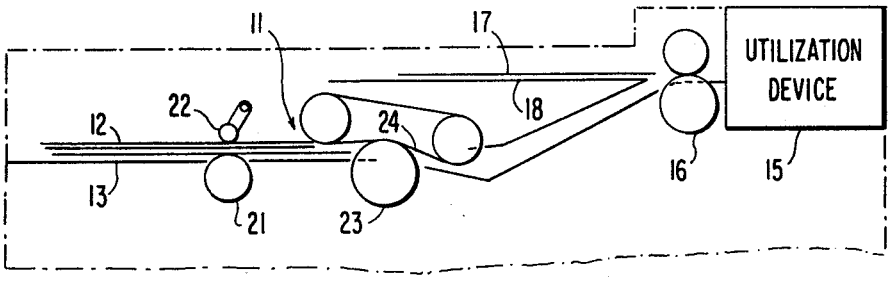
FIG. 2
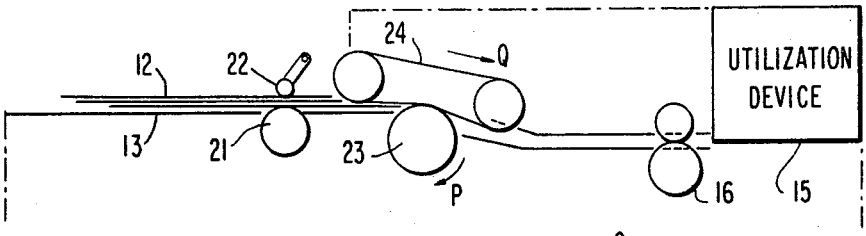
FIG. 3
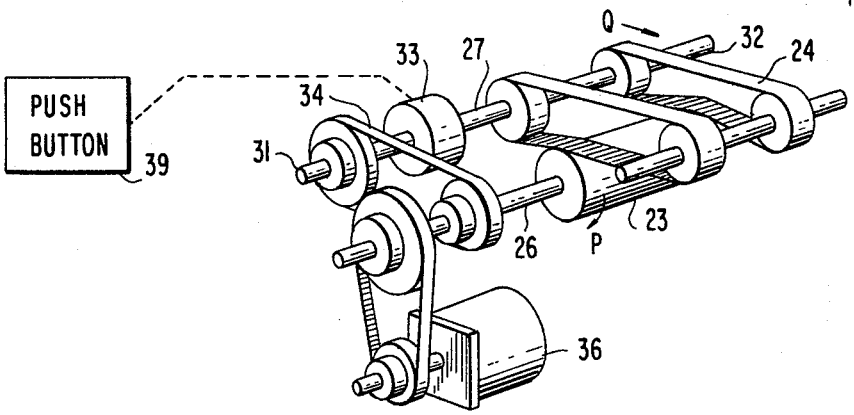
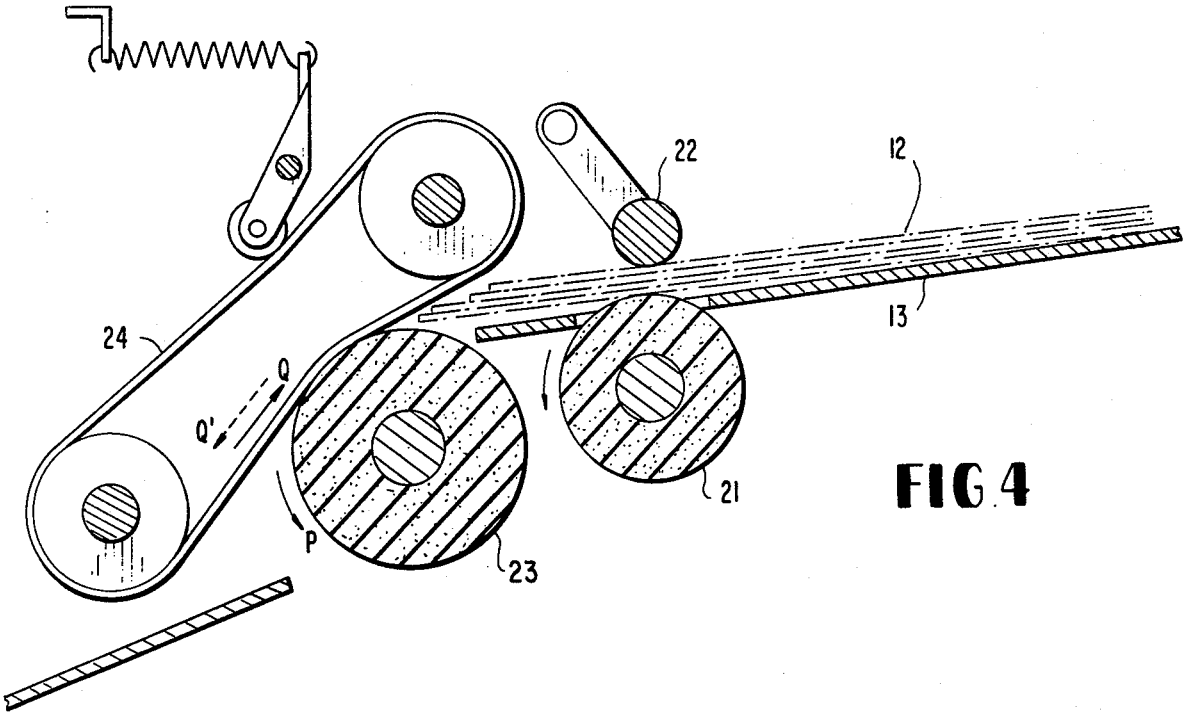
FIG. 4

PAPER FEEDER COMPRISING A SELECTIVELY DRIVABLE RESILIENT BODY IN FRICTIONAL CONTACT WITH A FEED ROLLER

BACKGROUND OF THE INVENTION

This invention relates to a paper feeder for feeding sheets of paper or the like, one at a time. A paper feeder according to this invention is specifically suitable in supplying originals to a facsimile or a similar transmitter.

In facsimile transmission, a paper feeder of the type described is often utilized on transmitting a plurality of originals in succession in order thereby to raise the efficiency of transmission and to save labor. In general, the quality of the originals is approximately specified or standardized in order to insure correct or reliable operation of the paper feeder. It is, however, often desired to transmit originals of qualities different from the standard originals, such as thin and/or flexible originals or an original composed of a paper or an equivalent and an original attached onto the ground. A sophisticated paper feeder is apt to erroneously feed two or more thin and/or flexible originals at a time. A known paper feeder comprises a first feeder unit for automatically feeding standard originals one by one and a second feeder unit for feeding thin and/or flexible originals which are separately manually supplied thereto. Due to separate provision of the two feeder units, the conventional paper feeder is bulky and expensive. Even with this conventional paper feeder, an original attached onto a ground sheet is liable to exfoliate from the ground sheet.

SUMMARY OF THE INVENTION

It is therefore an object of the present invention to provide a unitary paper feeder capable of reliably automatically feeding sheets of standard paper one by one and of reliably feeding a sheet of thin and/or flexible paper manually supplied thereto.

It is another object of this invention to provide a unitary paper feeder of the type described, which is further capable of reliably feeding a sheet of paper on which ground another sheet of paper is attached.

In accordance with this invention, there is provided a paper feeder which comprises a feed roller rotatable around a fixed axis, first means for driving the feed roller in a first sense of rotation, a resilient body movable along a circumferential area of the feed roller in frictional contact therewith, second means for controllably driving the resilient body, third means for supplying a sheet of paper towards the area, and selection means operatively coupled to the second means for making the latter positively drive the resilient body in a second sense at the area and for letting the latter set the resilient body free. The first sense is a sense away from the third means. The second sense is a reversed sense towards the third means.

BRIEF DESCRIPTION OF THE DRAWING

FIG. 1 is a schematic elevation of a conventional paper feeder;

FIG. 2 is a schematic general elevation of a paper feeder according to the present invention;

FIG. 3 is a schematic perspective view of principal portions of a paper feeder according to a first embodiment of this invention;

FIG. 4 is a schematic vertical sectional view of main portions of a paper feeder according to a second embodiment of this invention;

DESCRIPTION OF THE PREFERRED EMBODIMENTS

Figure 5:
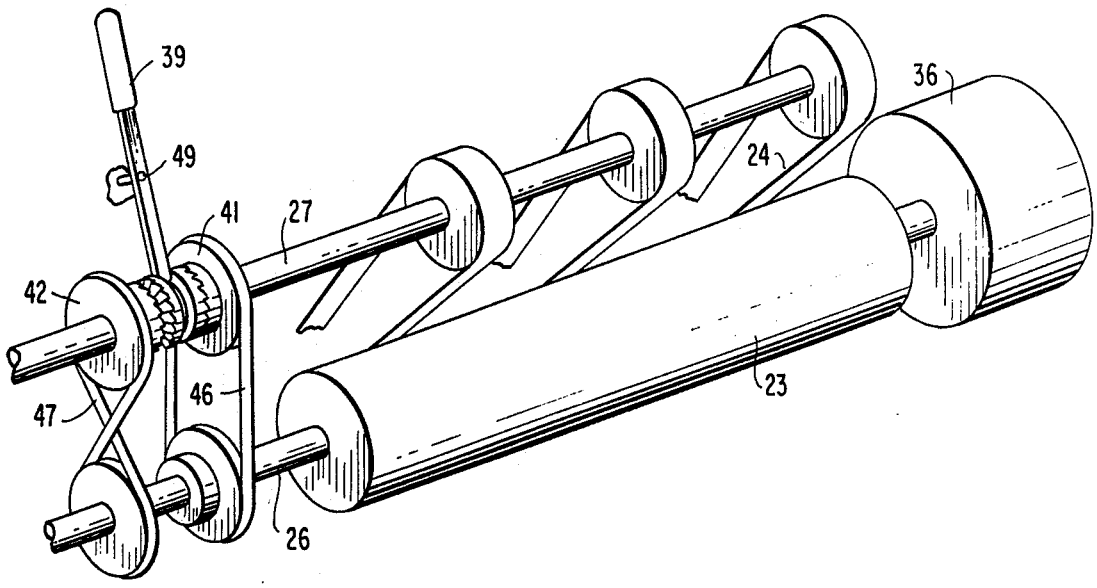
FIG. 5 is a schematic perspective view of the main portions, most of which is illustrated in FIG. 4.

Referring to FIG. 1, a conventional paper feeder will be described at first for a better understanding of the present invention. As summarized above, the conventional paper feeder comprises a first feeder unit 11 for automatically feeding one sheet of standard paper at a time from a stack 12 on a first tray 13 or equivalent to a utilization device 15, such as a facsimile transmitter, and a second feeder unit 16 for feeding to the utilization device 15 a sheet of non-standard paper 17, which is manually put on a second tray 18 or the like. The first feeder unit 11 comprises a preliminary feed roller 21 frictionally engaging a lowermost sheet of the stack 12 through a hole (not shown in FIG. 1) formed through the first tray 13, a preliminary pinch roller 22 urging the stack 12 towards the first tray 13, a main feed roller 23 rotated around a first fixed axis in a first sense or direction of rotation, and an endless belt 24 movable along a circumferential area of the main feed roller 23 in frictional contact therewith. The preliminary feed roller 21 cooperates with the pinch roller 22 to supply the lowermost sheet to the friction contact area, from where the main feed roller 23 feeds the sheet towards the second feeder unit 16 in cooperation with the belt 24.

Turning to FIG. 2, a paper feeder according to the present invention is a unitary paper feeder for feeding a sheet of paper from a stack 12 on a tray or table 13 to a utilization device 15 through, if desired, an auxiliary feeder 16 which is similar to the second feeder unit illustrated with reference to FIG. 1 and is consequently designated by the same reference numeral. The unitary paper feeder comprises a preliminary feed roller 21 and a preliminary pinch roller 22, both similar to those described in conjunction with the conventional paper feeder depicted in FIG. 1. As main or principal portions, the unitary paper feeder comprises a main feed roller 23 rotatable around a first fixed axis in a first sense of rotation P and an endless belt 24 movable along a circumferential area of the main feed roller 23 in frictional contact therwith. Preferably, the main feed roller 23 has a rubber surface (FIG. 4) of a higher coefficient of friction with respect to paper than the surface of the belt 24. As will be described hereunder with reference to the remaining figures of the accompanying drawing, the belt 24 is usually driven in a second sense Q, which is opposite to the first sense P, at the area of the friction contact. The belt 24 thus serves as a return or reverse belt for making the main feed roller 23 feed the lowermost sheet of the stack 12 alone, returning or feeding back one or more sheets of paper (FIG. 4) that might be superposed on the lowermost sheet and erroneously supplied contrary to the principle by the preliminary feed and pinch rollers 21 and 22 to the friction contact area. The belt 24 driven in the second sense Q, however, tends to damage a thin and/or flexible sheet of paper.

Referring to FIG. 3, a paper feeder according to a first embodiment of this invention comprises a main feed roller 23 and a pair of endless belts 24, all described hereinabove. A first shaft 26 drives the feed roller 23 in the first sense P. A second shaft 27 for controllably driving the endless belts 24 comprises a first axle 31 rotatable around a second fixed axis, a second axle 32 carrying the endless belts 24, a clutch 33 between the first and second axles 31 and 32, and a power transmission belt 34 for rotating the first axle 31. In the example of the first embodiment being illustrated, the first and second axes are parallel to each other. Furthermore, the first axle 31 is driven by the first shaft 26 in the same sense of rotation through the transmission belt 34. The first shaft 26 is driven, in turn, by an electric motor 36. The paper feeder further comprises a selector 39, such as a manually operable push button, for operating the clutch 33 either through a mechanical coupling or an electric connection depicted by a broken line. Usually, the first axle 31 drives the second axle 32 through the clutch 33 so as to make the illustrated paper feeder automatically feed one sheet of paper at a time from the stack 12. On feeding a thin and/or flexible sheet of paper, the selector 39 is operated so as to disengage the clutch 33. The endless belts 24 are thereby driven freely by the main feed roller 23, either with or without a sheet of paper interposed therebetween, to serve as a main pinch roller rather than as a return belt. Under the circumstances, a sheet of paper manually separately placed on the tray 13 (FIG. 2) is fed to the utilization device 15 without any trouble even if the paper is thin and/or flexible.

Figure 6:
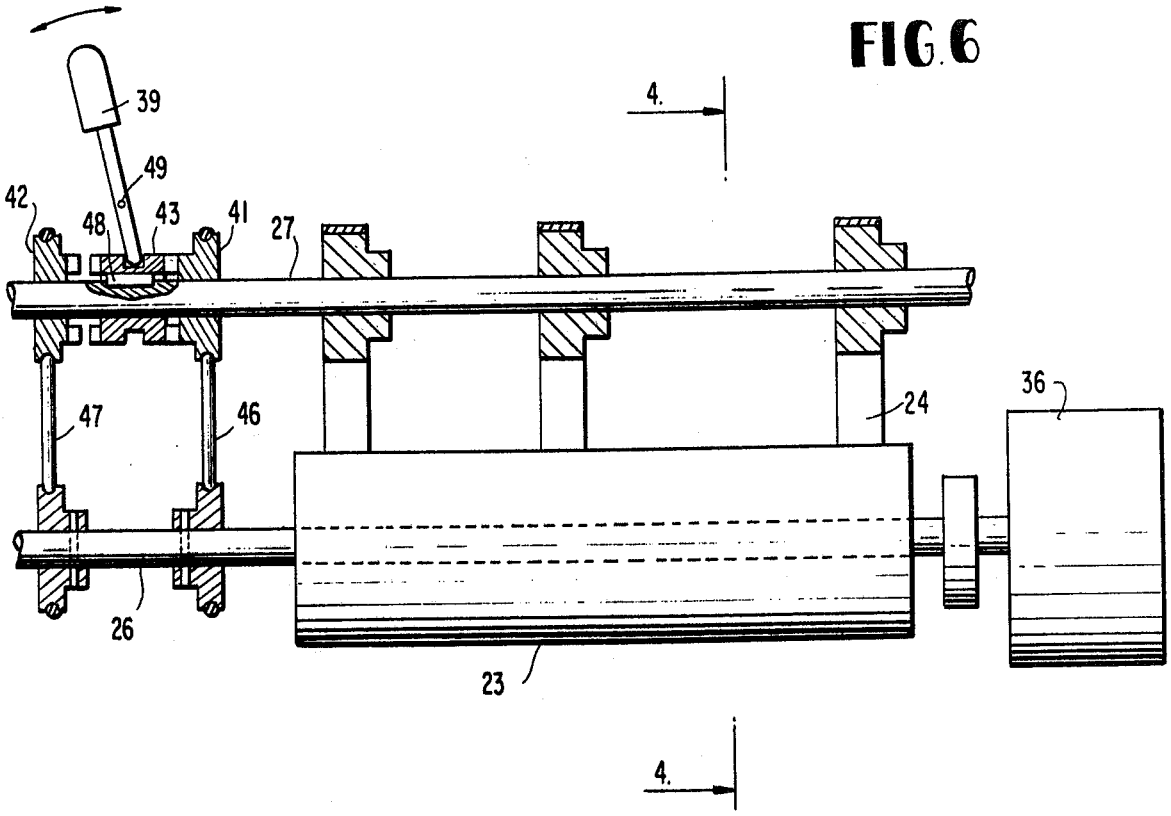
FIG. 6 schematically shows a front view of the main portions, partly in axial section, where a line 4—4 indicates a plane along which the vertical section shown in FIG. 4 is taken.

Referring now to FIGS. 4 through 6, a paper feeder according to a second embodiment of this invention comprises a main feed roller 23, three parallel endless belts 24, and a first shaft 26, all described hereinabove with reference to FIGS. 2 and 3. Driven by an electric motor 36, the first shaft 26 drives the feed roller 23 in the first sense P (FIG. 4). A second shaft 27 carrying the belts 24 is a single shaft rotatable around a second fixed axis and further carries a first pulley 41 freely rotatable at a first position, a second pulley 42 freely rotatable at a second position, and a sleeve 43 axially slidable between and selectably engagable with the first and second pulleys 41 and 42. The first and second pulleys 41 and 42 are driven by a first and a second transmission belt 46 and 47 in opposite senses. The sleeve 43 is keyed to the second shaft 27 at 48 (FIG. 6). In the example of the second embodiment being illustrated, the pulleys and sleeve 41–43 cooperate as a dog clutch for usually driving the second shaft 27 as to make the latter drive the endless belts 24 in the second sense Q at the areas of the frictional contact. The paper feeder according to the second embodiment of this invention further comprises a manually operable selector lever 39 pivoted at 49 and having an end engaging a circumferential indent formed in the sleeve 43. On feeding a specific sheet of paper, namely, either a thin and/or flexible sheet of paper or a sheet of ground or substrate onto which another sheet of paper is attached, the selector lever 39 is tilted rightwards in FIGS. 5 and 6 so as to make the second shaft 27 drive the endless belts 24 in a reversed sense Q′ (FIG. 4) that is the same as the first sense P at the friction contact areas. This enables the paper feeder to reliably feed a specific sheet of paper manually separately put on the tray 13 (FIG. 2) to the utilization device 15. During a shift of the sleeve 43 from engagement with one of the first and second pulleys 41–42 to engagement with the other, the endless belts 24 are naturally set free from being driven. This may be positively used to feed a thin and/or flexible sheet of paper, with the selector lever 39 put in a neutral position between the leftmost and rightmost positions.

While a few preferred embodiments of this invention have thus far been described, it will be understood from the above that a unitary paper feeder according to this invention may be modified in various manners. For example, the endless belt or belts 24 may be one or more pinch rollers or other resilient bodies, each movable along a circumferential area of the main feed roller 23 in frictional contact therewith.

What is claimed is:

1. A paper feeder for feeding various types of sheets of paper, one at a time, from a platform to a utilization device, said feeder comprising a feed roller rotatable around a fixed axis, first drive means for driving said roller in a first sense of rotation, a resilient body movable along a circumferential area of said feed roller in frictional contact therewith, second drive means for controllably driving said resilient body when operatively coupled thereto, and manually operable selection means for selectively operably coupling said second drive means and said resilient body in a first state to positively drive said resilient body in a second sense at said area when said sheet is of a predetermined nature and for selectively operably decoupling said second drive means and said resilient body when said sheet of paper is of a different nature, said first sense being a sense of feeding said sheet from said platform to said utilization device, said second sense being a reversed sense, wherein said manually operable means is further operative for selectively operably coupling said second drive means and said resilient body in a second state to positively drive said resilient body in said first sense at said area when said sheet comprises a ground sheet and another sheet attached thereto.

2. A paper feeder as claimed in claim 1 wherein said manual means comprises a clutch having forward, reverse and neutral positions.

3. A paper feeder as claimed in claim 1 wherein said resilient body is at least one endless belt.

* * * * *